US006033449A

United States Patent [19]

Cooper et al.

[11] Patent Number: 6,033,449

[45] Date of Patent: Mar. 7, 2000

[54] POLISHING TOOL

[76] Inventors: Alex Cooper, 3096 Brighton 6 St., #D3, Brooklyn, N.Y. 11285; Yakov Mikhlin; Yevgeny Bederak, both of 47 Longview Dr., Longmeadow, Mass. 01106

[21] Appl. No.: 08/971,753

[22] Filed: Nov. 17, 1997

[51] Int. Cl.[7] ..... B24D 3/00; B24D 3/02; B24D 3/28

[52] U.S. Cl. ..... 51/298; 51/299; 51/307; 51/309; 51/293

[58] Field of Search ..... 51/295, 298, 299, 51/307, 309, 293

[56] References Cited

U.S. PATENT DOCUMENTS

| | | | |
|---|---|---|---|
| 2,022,893 | 12/1935 | Martin | 51/307 |
| 3,631,638 | 1/1972 | Yoshikawa et al. | 51/298 |
| 3,632,320 | 1/1972 | Henmi et al. | 51/298 |
| 3,653,857 | 4/1972 | Field | 51/299 |
| 3,817,976 | 6/1974 | Bakul et al. | 51/298 |
| 3,959,194 | 5/1976 | Adelmann | 51/299 |
| 3,982,359 | 9/1976 | Elbel et al. | 51/299 |
| 5,092,082 | 3/1992 | Padberg et al. | 51/298 |

*Primary Examiner*—Michael Marcheschi
*Attorney, Agent, or Firm*—I. Zborovsky

[57] ABSTRACT

A polishing tool for polishing optical and technical glass, semiconductors, ceramics and other materials has a high concentration of cerium dioxide or aluminum oxide particles in the quantity of 85–96% by weight, and a high molecular binder based on synthetic rubber and including a combination of high-molecular components and other components for vulcanization, plasticization and stabilization.

2 Claims, 2 Drawing Sheets

POLISHING TOOL

BACKGROUND OF THE INVENTION

The present invention relates generally to polishing tools.

More particularly, it relates to tools for finish polishing of optical materials, technical glass, television screens, semiconductors, ceramics, etc.

Finish polishing tools of the above mentioned general type are known in the art. A finish polishing tool in order to be efficient for finish polishing of optical materials must reduce surface roughness from approximately 200 Å to 40–200 Å and remove the subsurface damage layer of approximately 5 $\mu$m deep. In well known tools for finish polishing of optical materials, two-component room temperature curing epoxy materials are used (resin and hardener) for binding polishing particles of $CeO_2$. In mass production of such finish polishing tools from epoxies there are problems related to reproducability and sizes of the tools. Although a low viscosity epoxy material can be doped with 75 weight percent of $CeO_2$, the doping with more than 80% of $CeO_2$ changes mechanical properties of the tool. The tool becomes very fragile, it has very low elasticity, it does not exhibit good flexibility, and has low workability. Such tools are difficult to manufacture with sizes more than 2–4 inch in diameter. The abrasive particles are also poorly mixed with the short life epoxy binder, the tool is insufficiently shaped in the process of curing, it has short service life.

SUMMARY OF THE INVENTION

Accordingly, it is an object of present invention to provide a polishing tool of the above mentioned general type, which avoids the disadvantages of the prior art.

In keeping with these objects and with others which will become apparent hereinafter, one feature of present invention resides, briefly stated, in a finish polishing tool for polishing optical and technical glass, semiconductors, ceramics, etc, comprising polishing particles composed of a material selected from the group consisting of cerium dioxide and aluminum oxide and provided in the tool in the quantity 85–96% by weight; and a high molecular binder including a high molecular component consisting of hundred part by weight of synthetic rubber, and materials for vulcanization, solidification, plasticitization and stabilization taken in part by weight:

| | |
|---|---|
| synthetic rubber | 100 |
| polyvinylchloride | 5–50 |
| phenol resin | 15–20 |
| calcium stearate | 0.5–1.0 |
| zinc oxide | 4–15 |
| magnesium oxide | 4–15 |
| timethyltiurate | 0.4–0.7 |
| sulfur | 1.7–25.0. |

The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

A finish polishing tool in accordance with the present invention for polishing optical and technical glass, semiconductors, ceramics, etc, has polishing particles composed of a material selected from the group consisting of cerium dioxide and aluminum oxide and provided in the tool in the quantity 85–96% by weight; and a high molecular binder including a high molecular component consisting of hundred part by weight of synthetic rubber, and materials for vulcanization, solidification, plasticitization and stabilization taken in part by weight:

| | |
|---|---|
| synthetic rubber (for example HVCAR 1205) | 100 |
| polyvinylchloride (for example (HVCAR VT-335) | 5–20 |
| phenol resin (for example DUREZ 12687) | 15–20 |
| calcium stearate | 0.5–1.0 |
| zinc oxide | 4–15 |
| magnesium oxide | 4–15 |
| timethyltiurate (for example PLASTOMAG) | 0.4–0.7 |
| sulfur | 1.7–25.0. |

In accordance further features of present invention the binder additionally can have dibutylphtalate or ALTAX in the quantity of 0.5–1.0 part by weight.

When the tool is formed in accordance with the present invention, it has a high concentration of abrasive particles such as cerium dioxide or aluminum oxide in a binder which is a high molecular component, and therefore mixing with high rate of homogeneity of the polishing particles and proper fixation is obtained. The tool has a specific flexibility and wear resistance within the range of 1:5 with the Shore hardness of 60–90, its productivity is 0.5–1.0 micrometer per minute. The tool is reproducable and it is practical to be made in a mass production substantially without limits of required sizes for using on all types of polishing machine tools, either the regular or CNC machine tools.

The tool can be formed with different shapes by using various techniques such as molds for making tools, dicing before thermal fixation or after it, without expensive mold forms. Any refuses of the manufacturing process can be used again in the same process. The manufacturing process is environmentally clean.

Figure 1A:
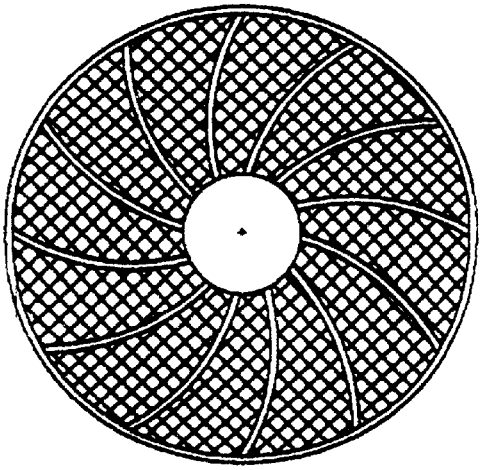
FIGS. 1*a* and 1*b* are a front view and a side view of a tool in accordance with the present invention.
Figure 1B:
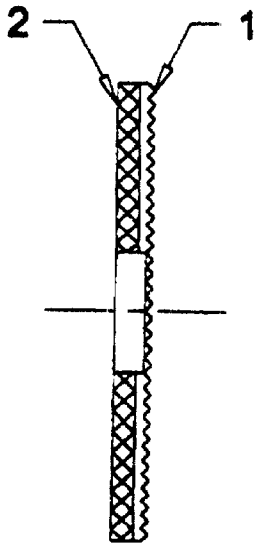

The tool in accordance with the present invention can be formed with different designs. As shown in FIG 1*a* and 1*b* the tool has a polishing layer 1 and a support 2. The polishing layer 1 has a plurality of curved segments composed in accordance with present invention of the high concentration of abrasive particles with the inventive binder, and separated from one another by gaps. The tool shown in FIGS. 1*a* and 1*b* is formed as a flat polishing disk.

Figure 2A:
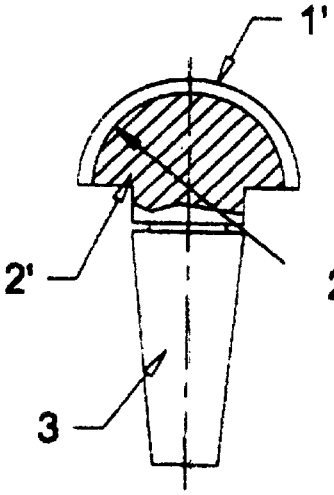
FIGS. 2*a*, 2*b*, 2*c* are views showing further modifications of the inventive tool.
Figure 2B:
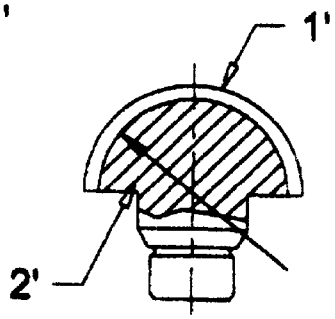
Figure 2C:
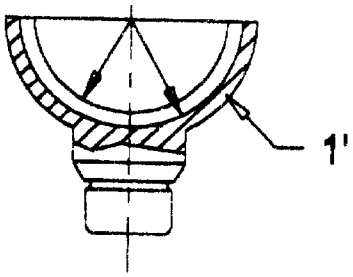

The tool shown in FIGS. 2*a*, 2*b*, 2*c* is used for polishing of spherical optics. It has a convex or concave working layer 1' and a convex or a concave support 2'. The tools shown in FIGS. 2*a* and 2*b* have identical working parts, but different connecting parts to be connected to a machine tool. The tool shown in 2*a* is provided with a connecting cone 3, while the tool shown in FIG. 2*b* is provided with a connecting thread.

Figure 3A:
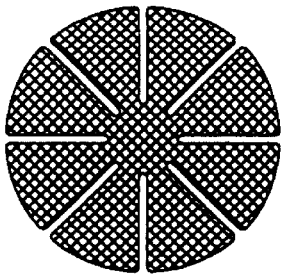
FIGS. 3*a* and 3*b* are views showing still further modifications of the inventive tool.
Figure 3B:
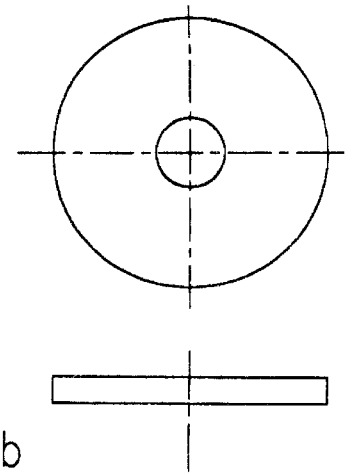

The tools shown in FIGS. 3*a* and 3*b* are used for polishing television screens. The tools shown in FIG. 3*a* is a diced tool which is formed as a disk having a plurality of polishing segments separated from one another by slots. For the tool shown in FIG. 3*b* is formed as a flat polishing disk.

Figure 4:
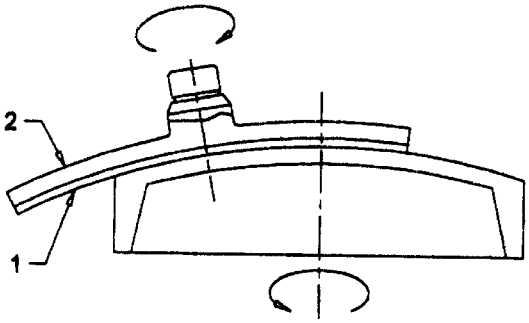
FIG. 4 is a view showing another tool in accordance with present invention.

FIG. 4 shows a point polishing tool for aspheric optical elements in accordance with the present invention. The tool rotates about its axis, the aspherical optical element rotates about its axis as well, and the tool moves along the surface of the aspheric optical element.

Figure 5:
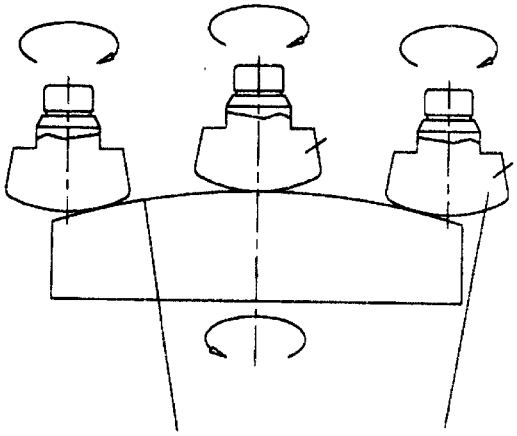
FIG. 5 is a view showing a tool in accordance with the present invention to be used on a CNC machine tool.

Finally, FIG. 5 shows a tool in accordance with the present invention which is formed as a polishing wheel for using on a CNC machine tool.

It will be understood that each of the elements described above, or two or more together, may also find a useful application in other types of constructions differing from the types described above.

While the invention has been illustrated and described as embodied in polishing tool, it is not intended to be limited to the details shown, since various modifications and structural changes may be made without departing in any way from the spirit of the present invention.

Without further analysis, the foregoing will so fully reveal the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A polishing tool for polishing optical glasses, technical glasses, semicondutors or ceramics, comprising 85–96 weight percent of an abrasive selected from the group consisting of aluminum oxide and cerium dioxide and a synthetic rubber binder, wherein the binder consists of the following components:

100 parts by weight of synthetic rubber,

5–50 parts by weight polyvinylchloride,

15–20 parts by weight phenol resin, 0.5–1.0 parts by weight calcium stearate,

4–15.00 by weight zinc oxide

4–15 parts by weight magnesium oxide, 1.7–25.0 parts by weight sulfur and optionally dibutylphthalate.

2. A polishing tool for polishing optical glasses, technical glass, semiconductors ceramics comprising 85–96 weight percent of an abrasive selected from the group consisting of aluminum oxide and cerium dioxide, and a synthetic resin binder consisting of polyvinylchloride, phenol resin, calcium stearate, zinc oxide, magnesium, sulpur and optionally dibutylphthalate.

* * * * *